US007549420B2

(12) United States Patent
Martinez et al.

(10) Patent No.: US 7,549,420 B2
(45) Date of Patent: Jun. 23, 2009

(54) PROTECTIVE HEADGEAR EQUIPMENT WITH RESPIRATOR AND OPTICAL SHIELD

(75) Inventors: Patrice Martinez, Le Perray (FR); Jean-Claude Urgel, Chesnay (FR); Patrick Maire, Raizeux (FR); Philippe Gerard, Beynes (FR); Xavier Flament, Saint-Gervais (FR)

(73) Assignee: Intertechnique (FR)

( * ) Notice: Subject to any disclaimer, the term of this patent is extended or adjusted under 35 U.S.C. 154(b) by 587 days.

(21) Appl. No.: 10/517,419

(22) PCT Filed: Jun. 10, 2003

(86) PCT No.: PCT/FR03/01730

§ 371 (c)(1),
(2), (4) Date: Dec. 8, 2004

(87) PCT Pub. No.: WO03/103774

PCT Pub. Date: Dec. 18, 2003

(65) Prior Publication Data

US 2005/0210556 A1 Sep. 29, 2005

(30) Foreign Application Priority Data

Jun. 10, 2002 (FR) ..... 02 07090

(51) Int. Cl.
*A62B 18/00* (2006.01)
*A62B 17/04* (2006.01)
*A62B 18/02* (2006.01)

(52) U.S. Cl. ..... 128/201.22; 128/200.27; 128/201.17; 128/201.24

(58) Field of Classification Search ..... 128/200.24, 128/200.27, 201.22–201.25, 201.17, 201.29
See application file for complete search history.

(56) References Cited

U.S. PATENT DOCUMENTS

| | | | | |
|---|---|---|---|---|
| 3,968,793 | A * | 7/1976 | Geissler | 128/206.23 |
| 3,971,368 | A * | 7/1976 | Forbes et al. | 128/201.15 |
| 4,774,939 | A * | 10/1988 | Disney | 128/200.24 |
| 5,630,412 | A | 5/1997 | Dubruille et al. | 128/206.23 |
| 5,954,052 | A * | 9/1999 | McDonald et al. | 128/206.27 |
| 6,039,045 | A | 3/2000 | Bertheau et al. | 128/207.11 |
| 6,085,748 | A | 7/2000 | Sword et al. | 128/206.23 |
| 6,401,716 | B1 * | 6/2002 | Sword et al. | 128/206.21 |

FOREIGN PATENT DOCUMENTS

| | | |
|---|---|---|
| EP | 0 2 88391 | 1/1988 |

* cited by examiner

*Primary Examiner*—Justine R Yu
*Assistant Examiner*—Kristen C Matter
(74) *Attorney, Agent, or Firm*—Dean W. Russell; Kristin M. Crall; Kilpatrick Stockton LLP

(57) ABSTRACT

The invention concerns a protective headgear comprising a respirator (2) capable of being connected to a breathing mixture source, an eye protecting shield (5) and first (32) and second (56) lock elements, respectively located on the respirator (2) and on the shield (6) and adapted to co-operate with each other to secure the shield (6) to the respirator (2), when the respirator is in its use position on the user's face, the first (32) and second (56) lock elements being adapted to be mutually engaged and interlocked by a movement bringing the shield (6) closer to the respirator (2), from above.

25 Claims, 8 Drawing Sheets

FIG.7
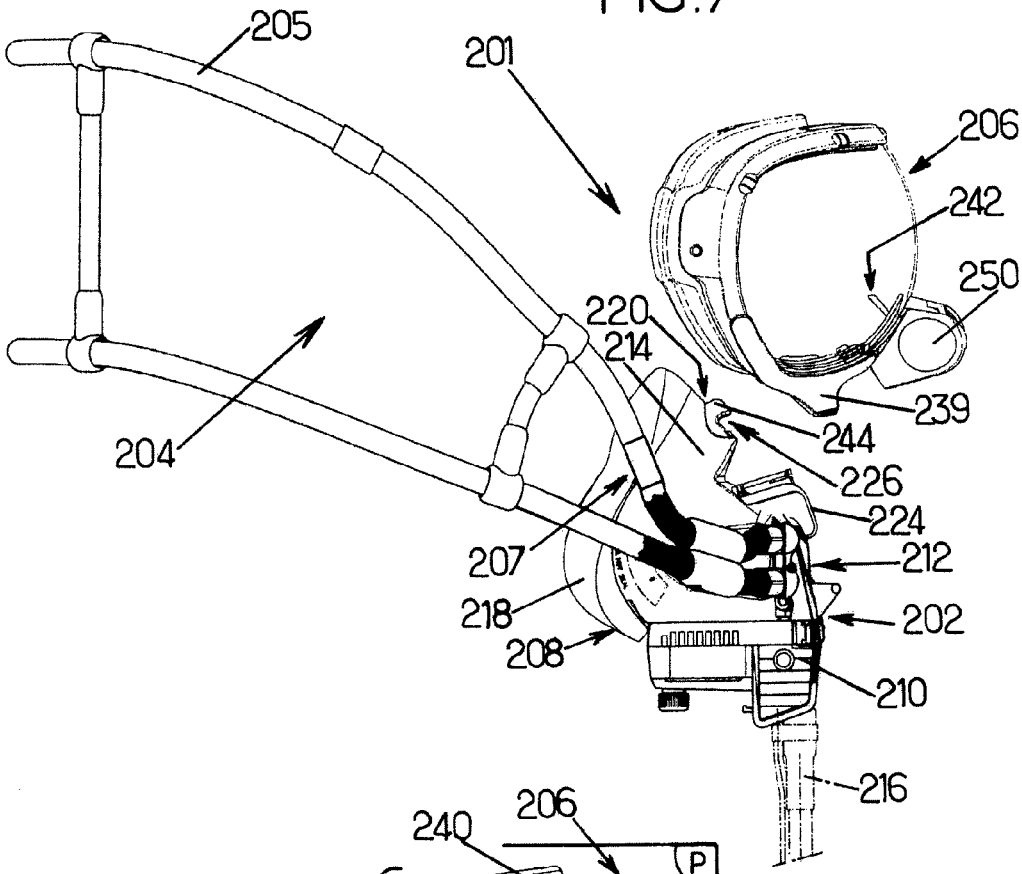
FIG.8
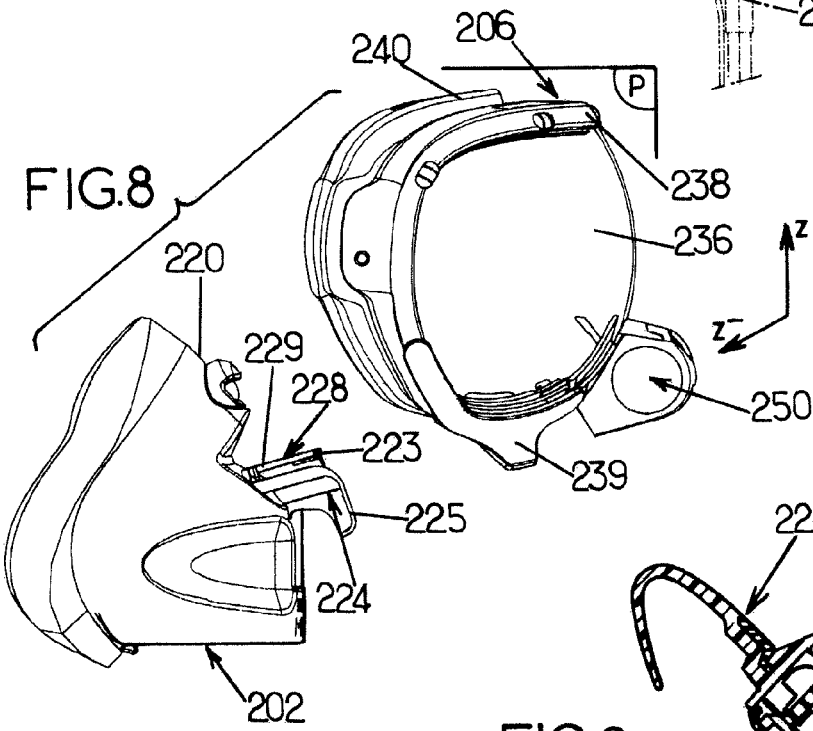
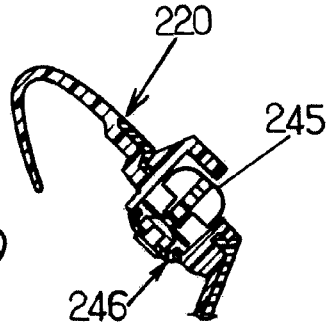
FIG.9

PROTECTIVE HEADGEAR EQUIPMENT WITH RESPIRATOR AND OPTICAL SHIELD

CROSS REFERENCE TO RELATED APPLICATIONS

This application is the U.S. national phase of International Application No. PCT/FR03/01730 filed on Jun. 10, 2003, which application claims priority to French Patent application No. 02/07,090 filed on Jun. 10, 2002, the contents of which are incorporated by reference herein.

The present invention relates to protective equipment for the head, with a breathing mask and an optical shield.

More particularly, the invention relates to protective equipment for the head comprising:

a breathing mask that can be connected to a breathing-gas source and adapted to be applied, in a position of use, over the bottom part of a user's face, around his nose and his mouth, and for supplying him with breathing gas, a shield for protecting the eyes adapted to be applied over the top part of the user's face, around his eyes, and first and second lock elements, respectively located on the mask and on the shield and adapted to cooperate with each other in order to secure the shield to the mask when the mask is in its position of use on the user's face.

The invention has a particularly important, though not exclusive, application in aeronautics. The mask then makes it possible to combat hypoxia or the inhalation of toxic gases. Regulations may also demand that pilots and co-pilots of transport aircraft wear equipment for protection against hypoxia permanently in certain flight conditions, and particularly at very high altitude or when a single pilot is present in the cockpit.

Document U.S. Pat. No. 5,630,412 describes an example of such protective equipment that is entirely satisfactory. However, it could be advantageous to have such equipment in which the positioning of the shield on the mask, in particular when the mask is already in place on the user's face, is carried out even more simply and more naturally.

The main object of this invention is to achieve these objectives.

For this purpose, according to the invention, there is provided protective equipment that, in addition to the characteristics already mentioned, is characterized by the fact that the first and second lock elements are adapted to engage and to interlock with each other by a movement of bringing the shield closer to the mask, this movement having a downward component, with reference to the top and bottom of the face.

Because of these arrangements, a user who is already wearing the mask (for example at very high altitude) and who must put on the shield (for example in order to protect himself from smoke and/or gases that are toxic or irritating on contact with the eyes) can with a simple and natural movement bring the shield in front of his eyes and press it downward onto the mask in order to secure it to the latter. The fact that the fixing of the shield on the mask is carried out in a simple and natural manner is particularly important in an emergency situation such as those generally necessitating the wearing of the shield.

In preferred embodiments of the invention, it is furthermore possible to have recourse to one and/or another of the following arrangements:

the second element comprises a nipple extending, starting from the shield, in a first direction comprising a downwardly directed oblique component, with reference to the top and bottom of the face;

the mask comprises a substantially conical cavity narrowing toward the first element in order to guide the second element toward the first element, in the movement of bringing the shield toward the mask;

the nipple is adapted to move longitudinally, substantially in the first direction, between a locked position and an unlocked position, within a grasping unit comprising grasping surfaces for a user's fingers;

it is provided with a push-button placed substantially between the grasping surfaces and manually operable in order to move the nipple from its locked position to its unlocked position;

the push-button has, in a direction substantially perpendicular to the first direction, an ergonomic surface for pressing the push-button, this surface having a dimension greater than 15 mm; conversely, the height of the push-button in the first direction is adapted to limit the overall dimensions of the protective equipment according to the invention and to facilitate its insertion in a storage box;

the mask has guidance surfaces, diverging from a ridge situated substantially in coincidence with the bridge of the user's nose, and the nipple is flanked by two side parts that are substantially symmetrical with respect to the median plane of symmetry of the face when the equipment is being worn by the user, these side parts extending between a high end close to the nipple and a low end distant from the nipple and becoming more distant from this plane toward their low end, in order to allow the guidance, by the guidance surfaces, of the positioning of the shield on the mask;

it comprises a locking indicator adapted to block, in an active position, any movement of the first element with respect to the second element and which can be in the active position only when the mask and the shield are secured to each other by a mutual interlocking of complementary shapes of the first and second lock elements;

the first and second lock elements are adapted to allow a movement of the shield with respect to the mask, and to favor the application of the shield over the user's face; by means of this arrangement, the equipment according to the invention adapts more easily to the different facial morphologies of users by allowing the shield to rock from front to rear in order to bring it closer to the user's forehead and to apply the shield around his eyes;

the first and second lock elements are mobile with respect to each other, about a horizontal axis, by means of two links;

the mask comprises a locking ramp adapted to guide the shield toward a locked position of the shield on the mask, while the shield is moving toward the mask;

the locking ramp is oriented with a component that is downward and toward the interior of the mask, in order to position the shield on the mask by a simple and natural movement;

it comprises spring means adapted to bring the shield toward the user's face, when the shield is secured to the mask and when the mask is worn by the user;

it comprises a harness fitted with straps adapted to maintain the mask in the position of use on the user's head and in which the shield comprises two guidance members adapted for each one respectively to become inserted under a strap of the harness when putting the shield into position on the mask; the shield can thus be applied over the user's face, by means of the straps, but with no manipulation by the user other than that of bringing the shield toward and locking it onto the mask; this arrangement makes it possible to have better sealing between the shield and the face without, however, requiring additional time for putting the shield into position;

the guidance members are adapted to cause the straps, under which they are inserted while the shield is being put into position on the mask, to rise over the sides of the shield; the straps thus apply the shield even more efficiently against the user's face; and the straps of the harness are provided with a sleeve, at the level of the places of insertion of the guidance members under these straps, in order to facilitate the shield being put into position and the insertion of the guidance members under the straps.

According to another aspect, the invention relates to a breathing mask for protective equipment such as mentioned above; the mask can comprise, in particular, a guidance ramp and/or straps provided with guidance sleeves at the level of the places of insertion of the members under these straps.

According to yet another aspect, the invention relates to a protective shield for protective equipment such as mentioned above; the shield can comprise guidance members adapted for each one respectively to be inserted under a strap of a harness when putting the shield into position on the mask.

According to another aspect, the invention relates to a support for the shield of the equipment such as mentioned above, comprising means of attaching the shield to this support, themselves comprising a lock element substantially identical to the first lock element, this lock element being adapted to cooperate with the second lock element and to fix the shield onto the support when the shield is not secured to the mask.

Advantageously, this support has means of attaching the mask that are independent of the means of attaching the shield and adapted to make it possible to detach the mask from the support without necessarily detaching the shield from it.

Other aspects, objects and advantages of the invention will become apparent on reading the description of two of its embodiments.

BRIEF DESCRIPTION OF THE DRAWINGS

The invention will also be better understood with the help of the drawings, in which:

FIG. 7 is a diagrammatic representation in perspective of a second embodiment of protective equipment according to the present invention;

FIG. 8 is a diagrammatic representation in perspective of the mask and the shield of the protective equipment of FIG. 7;

FIG. 9 is a diagrammatic representation in cross section of a detail of the breathing-gas inlet valve in the shield of the protective equipment shown in FIG. 7;

In the different figures, the same references indicate identical or similar elements.

DETAILED DESCRIPTION OF THE DRAWINGS

A first embodiment of the protective equipment according to the invention is described with reference to FIGS. 1 to 6.

Figure 1:
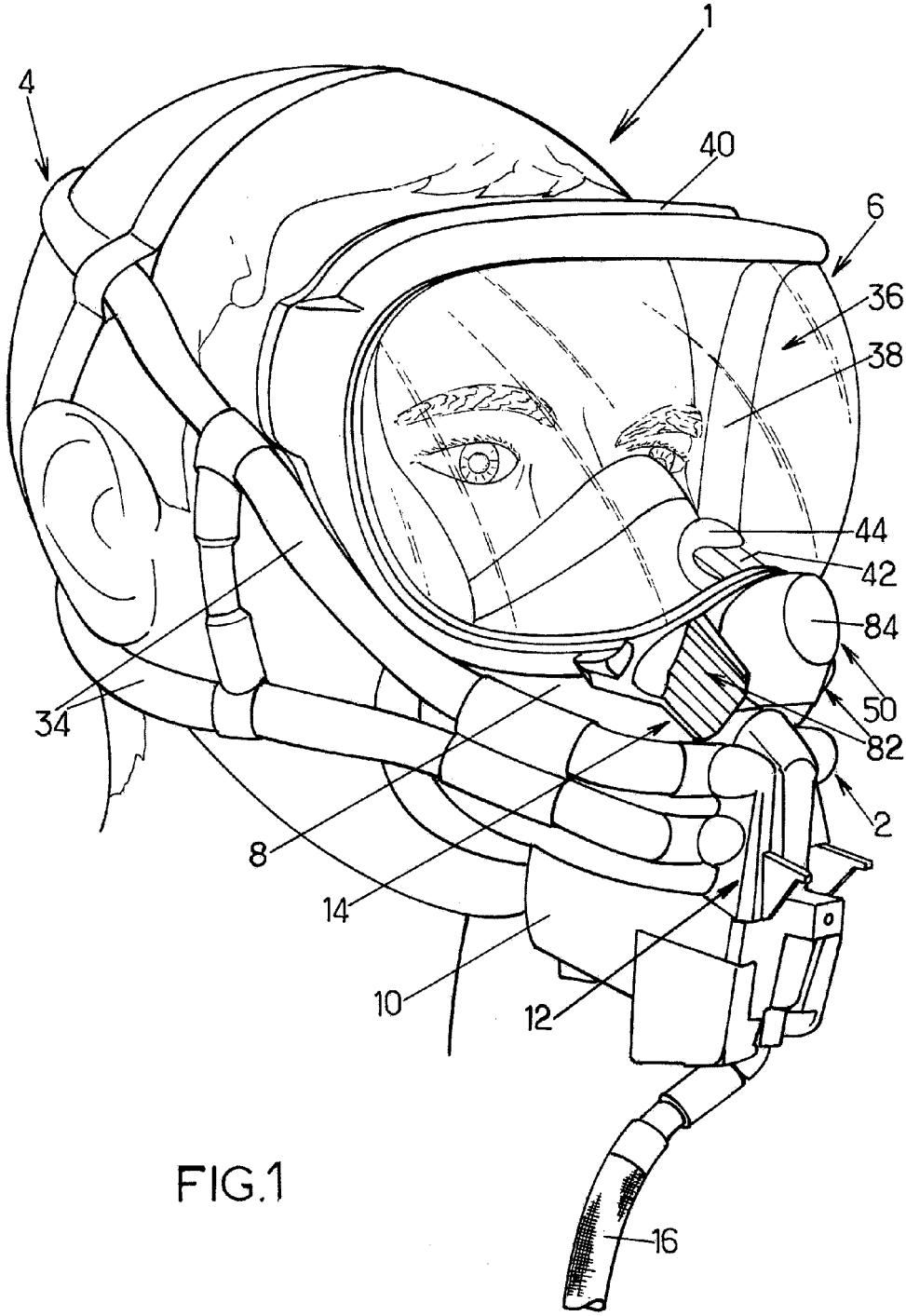
FIG. 1 is a diagrammatic representation in perspective of a first embodiment of protective equipment according to the present invention.

As shown in FIG. 1, this protective equipment 1 comprises a mask 2, a harness 4 and a shield 6.

The mask 2 and the harness 4 are of a known type. They are for example of the type of those already described by the documents EP-A-0288391 or U.S. Pat. No. 5,630,412.

The mask 2 comprises a mouth-and-nose face cover 8, a demand regulator 10, a connecting unit 12 and a shell 14. The demand regulator 10 is connected to a source of pressurized breathing gas by a flexible tube 16. The connection unit 12 connects the demand regulator 10 to the inflatable harness 4. The shell 14 covers the front of the mouth-and-nose face cover 8.

Figure 2:
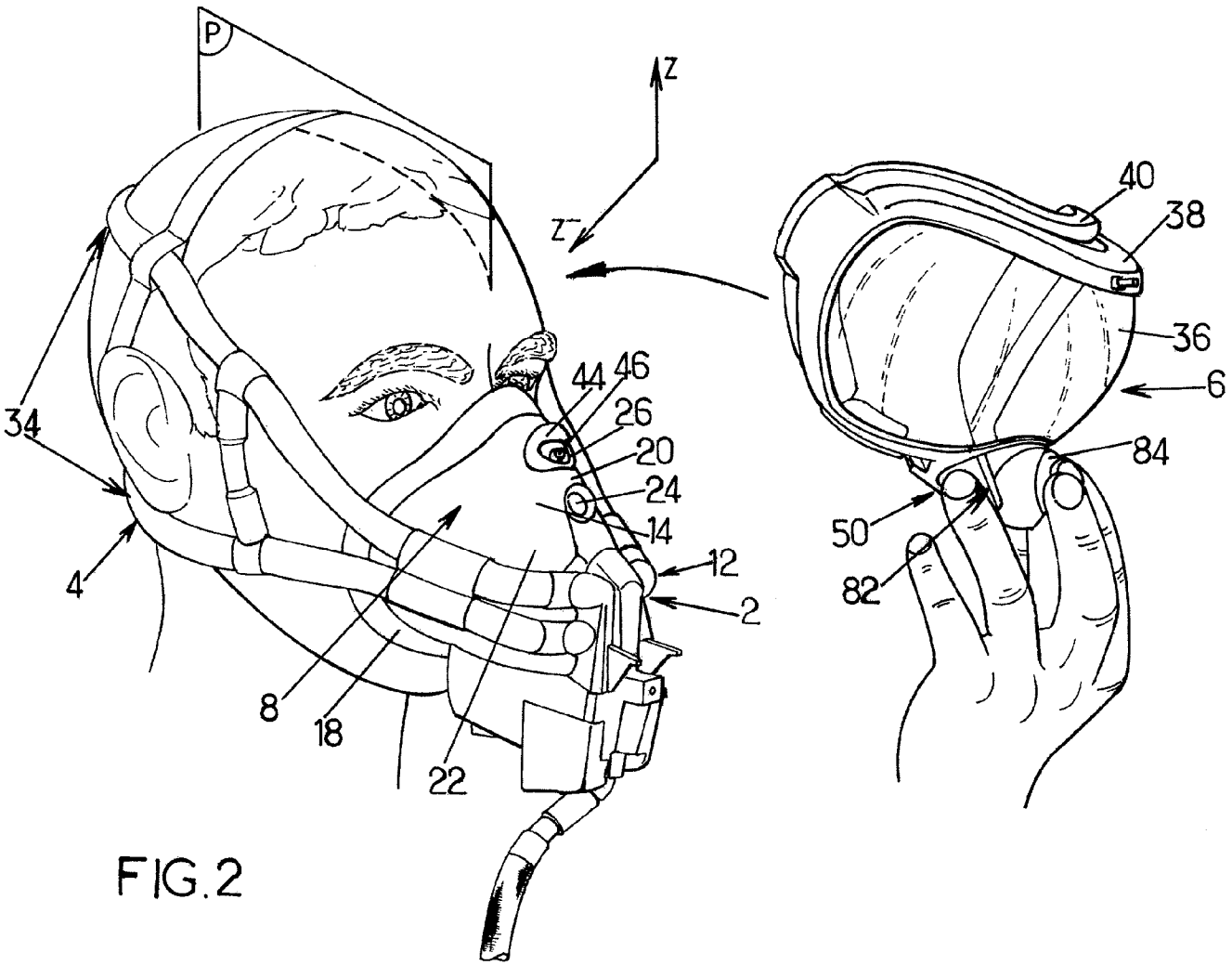
FIG. 2 is a diagrammatic representation, in a view similar to that of FIG. 1, of the protective equipment shown in FIG. 1 with its shield detached from the mask.

As shown in FIG. 2, the mouth-and-nose face cover 8 is adapted to be applied over the bottom of a user's face. The mouth-and-nose face cover 8 comprises a cavity covering the nose and the mouth of that user. This cavity is lined with a flexible membrane also extending all around the latter in order to form a seal 18 intended to be applied in contact with the user's face.

The shell 14 comprises a ridge surface 20 located substantially in coincidence with that of the user's nose when the user is wearing the mask 2. The shell 14 also comprises two guidance surfaces 22 which extend, starting from the ridge surface 20, downward while diverging with respect to a median plane P corresponding to the plane of symmetry of the user's head.

At the level of the ridge surface 20, the mouth-and-nose face cover 8 comprises a substantially conical cavity 24 and a valve 26. The valve 26 is located toward the top of the ridge surface 20. The cavity 24 is located between the valve 26 and the bottom of the ridge surface 20, close to the connection unit 12.

The cavity 24 has a substantially conical shape which narrows from the ridge surface 20 toward the inside of the mouth-and-nose face cover 8.

Figure 3:
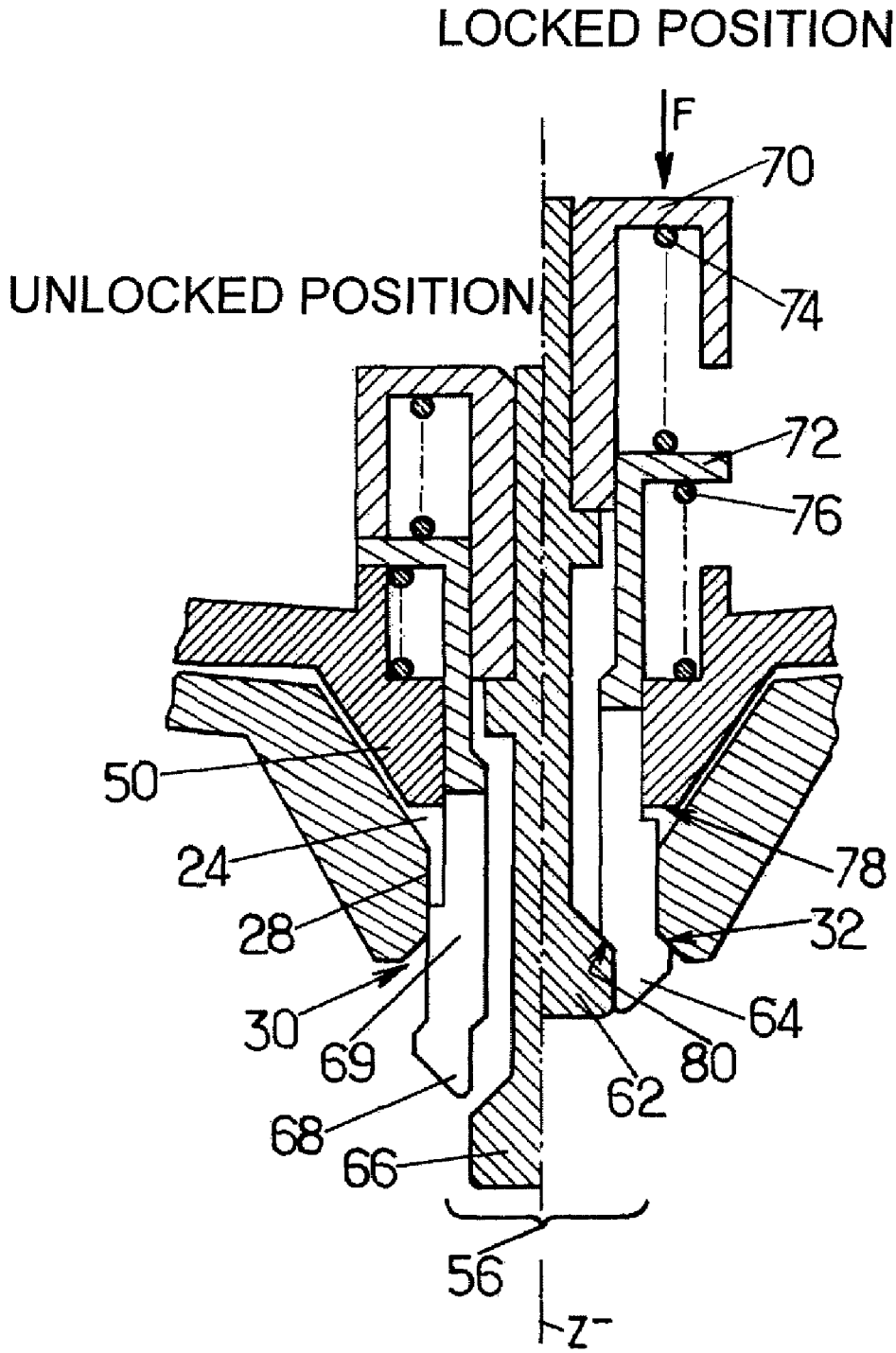
FIG. 3 is a diagrammatic representation in cross section, in the locked and in the unlocked position, of the means of locking the shield on the mask, for the embodiment of the protective equipment shown in FIGS. 1 and 2.

As shown in FIG. 3, at the bottom of the cavity 24, the conical surface continues with an internal cylindrical surface 28 which itself emerges into a flared opening 30 whose internal surface forms a first ramp 32. This first ramp 32 is circular and continuous about a direction Z-.

When the equipment 1 is on the head of a user and the latter has his head upright, the direction Z-extends in the plane P and its projection on a vertical axis Z comprises a non-zero downward vertical component. The ramp 32 forms a first lock element intended to cooperate with a second lock element located on the shield 6.

Returning to FIGS. 1 and 2, the harness 4 comprises two straps 34 each one consisting of a tube made of elastic material surrounded by a non-extensible cover. The two straps 34 have, when the tube is inflated, a length which allows then to pass around heads of all sizes. They are connected to the connection unit 12. After putting the mask 2 and the harness 4 into position on a user's head, the tubes of the straps 34 are deflated such that the elasticity of the tubes clamps the harness 4 on that user's head.

The shield 6 comprises a rigid window 36 of optical quality surrounded by a frame 38 made of relatively rigid plastic. The frame 38 is provided with a seal 40 adapted to apply a relatively large area in contact with the user's face.

The shield 6 and the mask 2 are advantageously produced in such a way as to organize a circulation of breathing gas in the shield 6 when the latter is in position on the user's face. In particular, when putting the shield 6 in position on the mask 2, the valve 26, which is closed when the shield 6 is not in position, opens to take in breathing gas from inside of the mask 2 toward the interior of the shield 6. The breathing gas can escape by leakage between the seal 40 and the skin. Slits can also be provided in the upper part of the seal 40 in such a way as to guide the breathing gas sweeping the volume situated between the face and the shield 6.

The opening of the valve 26 when putting the shield 6 in position on the mask 2 is achieved by the insertion of a tongue 42 (see FIGS. 1 and 4) under a rim 44 overhanging the valve 26 (see FIGS. 1 and 2). When the tongue 42 is inserted under the rim 44, it presses a piston 46, thus opening a breathing gas inlet channel connecting the connection unit 12 with the volume situated between the shield 6 and the user's face. When the shield 6 is detached from the mask 2, a spring, which is not shown, pushes the piston 46 back toward a seat, which is also not shown, in order to close the inlet channel. Advantageously, the inlet channel emerges at the level of the piston 46 in such a way that the breathing gas escapes, into the shield 6, directly through the valve 26. Other means of managing the in flow of breathing gas into the shield 6 can also be envisaged.

Figure 4:
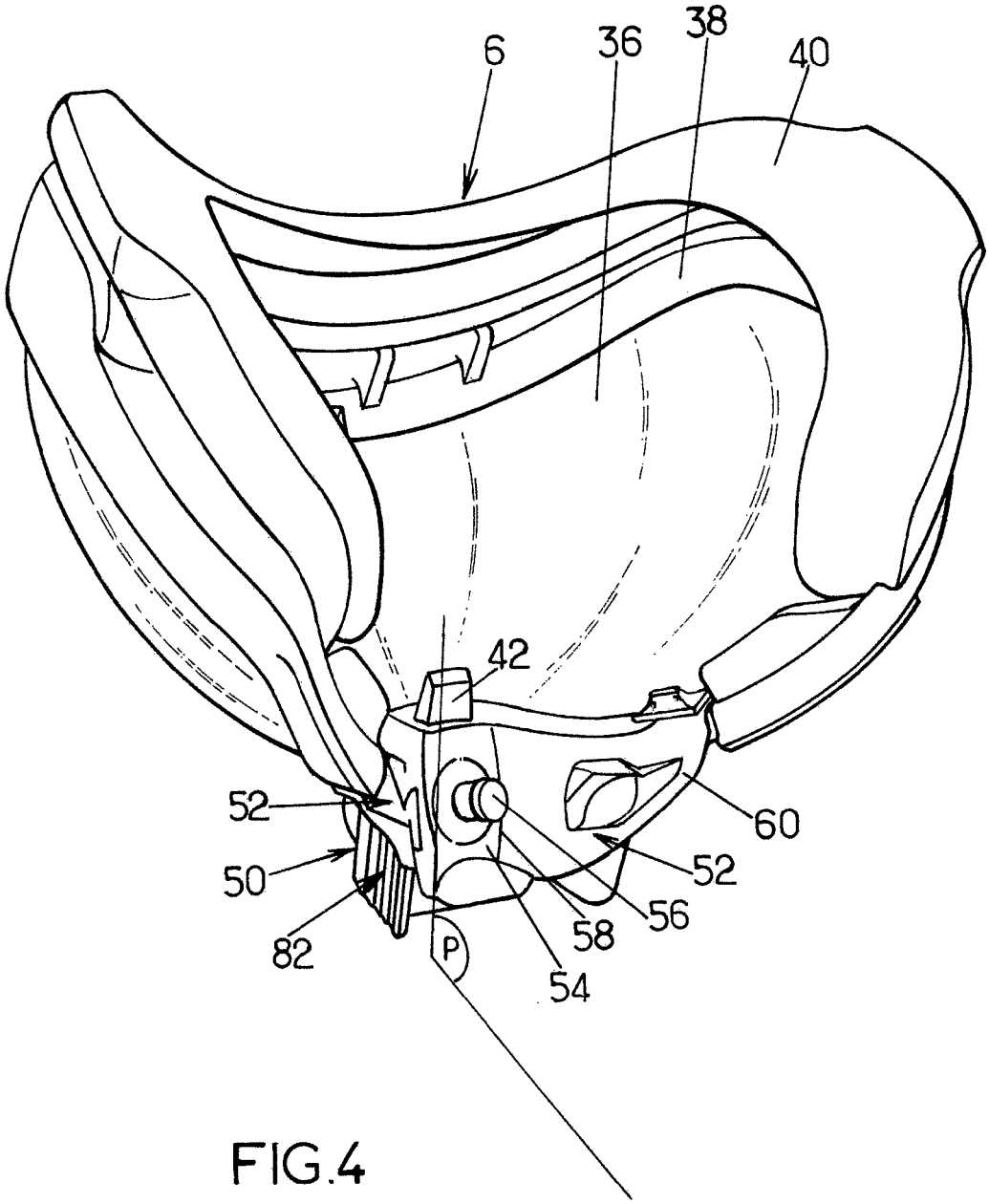
FIG. 4 is a diagrammatic representation in perspective, seen from the inside, of the shield of the embodiment of the protective equipment shown in FIGS. 1 and 2.

As shown in FIG. 4, the shield 6 comprises a fixing-grasping unit 50 provided to allow the shield 6 to be put into position quickly and easily on the shell 14 of the mask 2. The means of locking the shield 6 on the mask 2 can have very diverse constitutions and the embodiment described below is only one example.

In this embodiment, the fixing-grasping unit 50 that is part of the shield 6 and comprises a substantially inverted "V" shape when it is considered in cross section through a plane perpendicular to the plane P of symmetry of the face, when the shield 6 and the mask 2 are in position on the user's head.

This V-shape comprises two side parts 52 that are substantially symmetrical with respect to the median plane P of symmetry of the face, when the equipment 1 is being worn by the user. These side parts 52 meet at the level of a central zone 54 from which extends a nipple 56. The nipple 56 constitutes the second lock element which cooperates with the ramp 32 in order to secure the shield 6 to the mask 2.

The side parts 52 extend between a high end 58 close to the nipple 56 and a low end 60 distant from the nipple 56. These side parts 52 become more distant from the plane P of symmetry of the face toward their low end 60. These side parts 52 allow guidance, by the guidance surfaces 22 of the mask 2, facilitating the positioning of the shield 6 on the mask 2.

As shown in FIG. 3, the nipple 56 consists of an inner rod 62 and an outer rod 64.

The inner rod 62 is for example made of metal and the outer rod 64 is for example made of plastic.

The outer rod 64 forms a sleeve around the inner rod 62. This sleeve has, over substantially half of its length, cutouts such that half of the outer rod 64 located beside its free end forms elastic tongues 69.

The inner 62 and outer 64 rods extend between a free end comprising a boss 66, 68 and a pressure surface 70, 72 by the intermediary of which a force F is transmitted to the nipple 56 in order to move the nipple 56 longitudinally, substantially in the first direction Z-, between a locked position (right hand side of FIG. 3) and an unlocked position (left hand side of FIG. 3), within the fixing-grasping unit 50.

First 74 and second 76 springs are respectively interposed on the one hand between the inner rod 62 and the outer rod 64 and, on the other hand, between the outer rod 64 and the fixing-grasping unit 50. These springs 74, 76 push the nipple 56 back toward the inside of the fixing-grasping unit 50.

The fixing-grasping unit 50 has, symmetrically with respect to the median plane P of symmetry of the face, grasping surfaces 82 which extend upwards on either side of the push-button 84 integral with the pressure surface 70 of the inner rod 62 (see FIGS. 1, 2 and 4).

In the released position (substantially corresponding to the unlocked position), but when the shield 6 is not firmly attached to the mask 2, the outer rod 64 is blocked against the action of the second spring 76 at the level of a stop 78 and the inner rod 62 is blocked against the action of the first spring 74, on a ramp 80 formed on the inner surface of the outer rod 64.

In order to put the shield 6 in position on the mask 2, the user grasps the shield 6 by means of the fixing-grasping unit 50 and then, in the described embodiment, presses the push button 84, using one or two fingers, while he is grasping the grasping surfaces 82 between the thumb and one or more other fingers. By pressing on the push button 84, the user makes the nipple 56 emerge from the fixing grasping unit 50. More precisely, the inner rod 62 is moved longitudinally and parallel with the direction Z- until the boss 66 is clear of the outer rod 64. Thus, when the shield 6 is brought toward the mask 2, the side parts 52 are guided by the guidance surfaces 22. Then, when the shield 6 is close to the mask 2, the more precise positioning of the shield 6 on the mask 2 is guided by the entrance of the nipple 56 into the cavity 24. As the boss 66 is clear of the outer rod 64, the tongues 69 of this outer rod 64 can be deformed radially toward the inner rod 62 until the boss 68 of the outer rod 64 is at the level of the flared opening 30. The tongues 69 of the outer rod 64 can then separate radially outwards.

The calibration of the first 74 and second 76 springs is determined such that the boss 66 of the inner rod returns inside the outer rod 64 before the boss 68 of the outer rod 64 returns to the level of the flared opening 30, when the user releases the push button 84, the flare 68 of the rod 64 is then locked in the flared opening 30. Thus, the tongues 69 of the outer rod 64 are retained radially outwards. The action of the first 74 and second 76 springs contributes to keeping the shield 6 pressed tightly against the mask 2.

In order to detach the shield 6 from the mask 2, the user grasps the shield 6 at the level of the grasping surfaces 82 and applies a pressure to the push button 84. The bosses 66, 68 are then clear of the flared opening 30. By pulling on the shield 6, whilst keeping the push button 84 pressed, the user disengages the nipple 56 from the cavity 24. More precisely, the tongues 69 of the outer rod 64 deform radially inwards during the passage of the boss 68 at the level of the flared opening 30 and of the cylindrical inner surface 28, which is made possible by the fact that the boss 66 of the inner rod 62 is no longer inside the outer rod 64.

Figure 5:
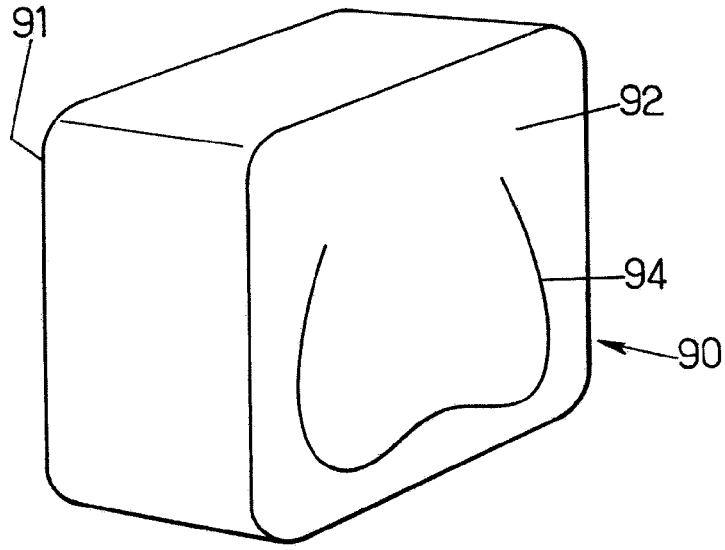
FIG. 5 is a diagrammatic representation in perspective of a storage box for the shield shown in FIG. 4.

The mask 2 and the shield 6 of the equipment 1 according to the invention can be stored independently of each other. The mask 2 can be placed, when it is not in use, on a support or in a conventional box. The shield 6, when it is not in use, can be stored in a shield box 90 or simply hooked. FIG. 5 shows an embodiment of such a shield box 90. It is, for example, a rubber box with a front panel 92 having a cutout 94 which allows the shield 6 to be inserted into the box 90 or to extract it from it. When the shield 6 is in the box 90, the fixing-grasping unit 50 at least partially protrudes from the cutout 94 in order to facilitate the grasping of the shield 6 and its extraction from the box 90. The box 90 is fixed, by its rear panel 91, for example to an inside wall of the aircraft.

Figure 6:
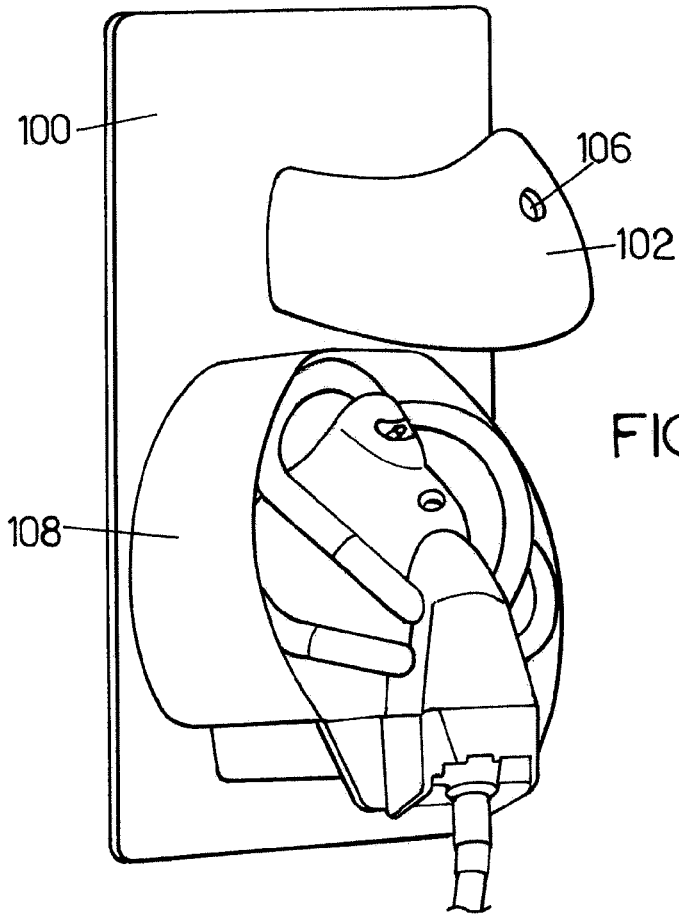
FIG. 6 is a diagrammatic representation in perspective of an example of a support for the protective equipment shown in FIGS. 1 and 2.

According to a variant, the shield 6 is placed, when it is not in use, on a stand 100. As an illustration, one example of such a stand 100 is shown in FIG. 6. This stand 100 comprises a shield holder 102, having a shape substantially similar to that of the shell 14. This shield holder 102 comprises a cavity 106 identical to the cavity 24 of the mask 2. Thus, if the user removes the shield 6 from the mask 2 in order to place it on the stand 100, he acquires by this movement the memory of the place where the shield 6 has been stored and of the movement that he will have to make in order to position the shield 6 on the mask 2. In an emergency, he will take the shield 6 again in order to position it on the mask 2 with a movement that he knows.

Advantageously, for similar reasons, the stand 100 comprises a mask holder 108. On the stand 100, the shield 6 and the mask 2 are stored independently of each other. If the user takes the mask 2 from the mask holder 108 in order to put it on himself, he memorizes at the same time the place where the shield 6 is. Thus, in an emergency, the user will be able to find the shield 6 at a place that he already knows.

There can be numerous variants of the equipment according to the invention.

For example, according to one of these variants, the equipment according to the invention comprises a locking device adapted such that a user only has to press the shield 6 onto the mask 2 in order for them to become interlocked with each other and only has to apply traction at the level of grasping elements in order to unlock this locking device and to remove the shield 6 from the mask 2, using movements substantially corresponding to those of putting spectacles on and taking them off the nose.

One example of such an arrangement is illustrated by the second embodiment of the equipment according to the invention described below with reference to FIGS. 7 to 15.

As shown in FIG. 7, this protective equipment 201 comprises a mask 202, a harness 204 and a shield 206.

The mask 202 and the harness 204 are of a known type. They are for example of the type of those already described by the documents EP-A-0 288 391 or U.S. Pat. No. 5,630,412.

The mask 202 comprises a mouth-and-nose face cover 208, a demand regulator 210, a connecting unit 212 and a shell 214. The demand regulator 210 is connected to a source of pressurized breathing gas by a flexible tube 216. The connection unit 212 connects the demand regulator 210 to the inflatable harness 204. The shell 214 covers the front of the mouth-and-nose face cover 208.

The mouth-and-nose face cover 208 is adapted to be applied over the bottom of a user's face. As shown in FIGS. 7 and 8, the mouth-and-nose face cover 208 comprises a cavity intended to cover the nose and the mouth of that user. This cavity is lined with a flexible membrane also extending all around the latter in order to form a seal 218 intended to be applied in contact with the user's face.

The shell 214 comprises a ridge surface 220 located substantially in coincidence with that of the user's nose when the user is wearing the mask 202.

At the level of the ridge surface 220, the mouth-and-nose face cover 208 comprises a valve 226. The valve 226 is located toward the top of the ridge surface 220.

The shell 214 comprises a locking ramp 224. The locking ramp 224 is located at the bottom of the ridge surface 220, between the valve 226 and the connection unit 212.

When the equipment 201 is on a user's head and the latter has his head upright, it is possible to define a plane P which corresponds to the plane of the sheet of paper on which FIG. 8 appears. This plane P corresponds to the plane of symmetry of the user's head. It passes through the apex of the ridge surface 220. A vertical direction Z is also defined, which extends from bottom to top with reference to the top and the bottom of a user's face.

The locking ramp 224 has the shape of a hook with its concavity facing downward, with a first branch 223 oriented with a component Z- directed from top to bottom and toward the inside of the mask and a second branch 225, substantially perpendicular to the first branch 223 and with a free end located below this first branch 223. Thus, if the user brings the shield 206 too low over the mask 202, the shield 206 slides over the second branch which raises it toward the first branch 223, by which it is guided toward its locked position. The user therefore brings the shield 206 toward the face cover 208 with a simple and natural movement and brings the shield 206 into the locked position with a movement comprising a component directed from top to bottom. In this way, the user can, when he puts the shield 206 into position on the face cover 208, only contribute to the good positioning of the mask 202 on his face. This arrangement is particularly important in an emergency situation such as one that generally necessitates the wearing of the shield 206.

Figure 10:
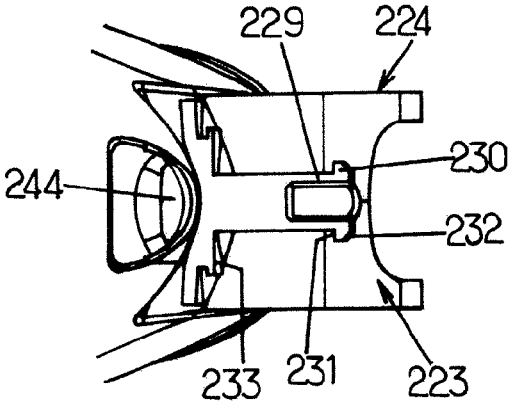
FIG. 10 is a diagrammatic representation in perspective and seen from above, at the level of the locking ramp, of the mouth-and-nose face cover of the equipment shown in FIG. 7.

As shown in FIGS. 8 and 10, the first branch 223 comprises two slides 228, disposed on either side of the plane P, symmetrically with respect to the latter, and extending in the direction Z-. Each slide 228 has a locking blade 229 mounted over it.

Each locking blade 229 comprises a free end shaped as a pin 230 extending in opposite directions, substantially horizontally and perpendicular to the locking blades 229. These locking blades 229 are sufficiently flexible to be elastically deformed over a displacement substantially corresponding to the length of the pins 230. Each pin 230 comprises a straight edge 231, substantially perpendicular to the locking blades 229 and a slanting edge 232. Each straight edge 231 makes it possible to retain the locking blades 229 in the locking element in which they are intended to be inserted. Each slanting edge 232 makes it possible to facilitate their deformation and their insertion into this locking element.

At the base of the locking blades 229 are located two protuberances 233 forming a hard point as will be explained below.

The shield 206 comprises a rigid window 236 of optical quality surrounded by a frame 238 made of relatively rigid plastic. The frame 238 is provided with a seal 240 adapted to apply a relatively large area in contact with the user's face. The shield 206 and the mask 202 are advantageously produced in such a way as to organize a circulation of breathing gas in the shield 206 when the latter is in position on the user's face. In particular, when putting the shield 206 in position on the mask 202, the valve 226, which is closed when the shield 206 is not in position, opens to take in breathing gas from inside the mask 202 toward the interior of the shield 206.

The breathing gas can escape by leakage between the seal 240 and the skin. Slits can also be provided in the upper part of the seal 240 in such a way as to guide the breathing gas sweeping the volume situated between the face and the shield 206. The opening of the valve 226 when putting the shield 206 in position on the mask 202 is achieved by the insertion of a tongue 242 under a rim 244 overhanging the valve 226. When the tongue 242 is inserted under the rim 244, it presses a piston 245 (see FIG. 9), thus opening a breathing gas inlet channel connecting the connection unit 212 with the volume situated between the shield 206 and the user's face. When the shield 206 is detached from the mask 202, a spring pushes the piston back toward a seat 246 in order to close the inlet channel.

As shown in FIG. 8, the shield 206 comprises an attachment nose 250 provided for allowing the shield 206 to be put into position quickly and easily on the shell 214 of the mask 202. The means of locking the shield 206 on the mask 202 can have very diverse constitutions and the embodiment described below is only one example.

Figure 11:
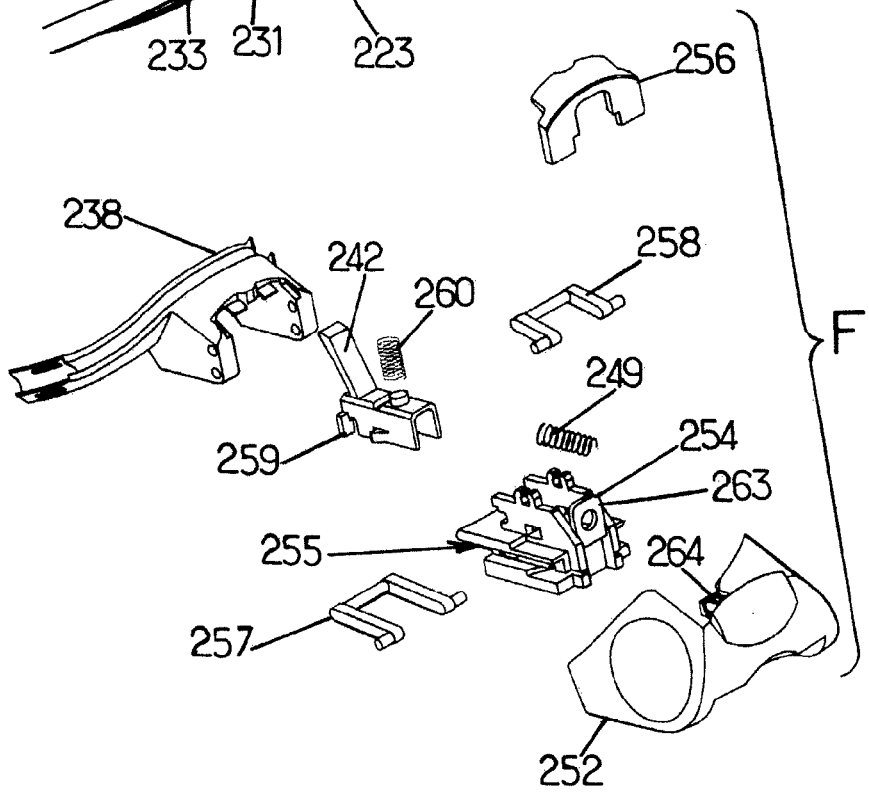
FIG. 11 is a diagrammatic representation in perspective and in an exploded view of the attachment nose of the shield shown in FIGS. 7 and 8.

In the embodiment shown in FIG. 11, the attachment nose 250 comprises a grasping device 252, a carriage 254 and a protective casing 256.

The grasping device 252 is mounted in a sliding manner on the carriage 254. A spring 249 is interposed between the carriage 254 and a key 263 and a spindle 264, connected to the grasping device 252, passes through the middle of the spring 249. The spring 249 is located on the other side of the grasping device 252, with respect to the key 263. The spring 249 is under compression. It tends to separate the grasping device 252 and the carriage 254 from one another.

The carriage 254 comprises slides 255 intended to cooperate with the first 223 and second 225 branches of the locking ramp 224. When the shield 206 is locked on the mask 202, the carriage 254 is therefore fixed with respect to the mask 202.

Figure 12:
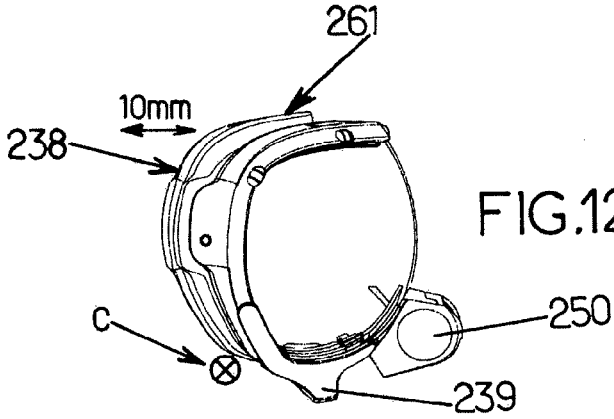
FIG. 12 is a diagrammatic representation in perspective of the shield shown in FIGS. 7 and 8.

The carriage 254 is mounted on the frame 238 by the intermediary of a first link 257 and of a second link 258. As shown in FIG. 12, the first link 257 and the second link 258 allow the frame 238, and therefore the shield 206, to pivot about an axis of rotation C in such a way as to take up a play at the level of the upper edge 261 of the seal 240 by a substantially horizontal displacement which can be as much as about 10 mm.

Referring again to FIG. 7, the frame 238 comprises guidance members 239 intended to be inserted, without additional manipulation by the user, under the straps 205 of the harness, when the user positions the shield on the mask 202. More precisely, the straps are provided with sleeves 207, at the level of the places of insertion of the guidance members 239. These sleeves 207 facilitate the insertion of the guidance members 239 under the straps 205. Furthermore, the guidance members 239 are shaped in such a way as to cause the straps 205 to rise over the sides of the frame 238 in order to apply the seal 240 more effectively onto the user's face.

Referring again to FIG. 11, a ventilation finger 259 is rigidly connected to the carriage 254. The ventilation finger 259 is mounted beneath the tongue 242, which is therefore fixed with respect to the mask 202, when the shield 206 is fixed to the mask 202. A shield spring 260 is interposed between the ventilation finger 259 and the frame 238. Thus, this shield spring 260 pushes the shield 206 rearwards, that it to say toward the user's face when the equipment 201 is in the position of use on that user's head.

The protective casing 256 covers the carriage 254, in the variable space left between the frame 238 and the grasping device 252, while allowing the movement of the moving parts, carriage 254 and grasping device 252.

Figure 13:
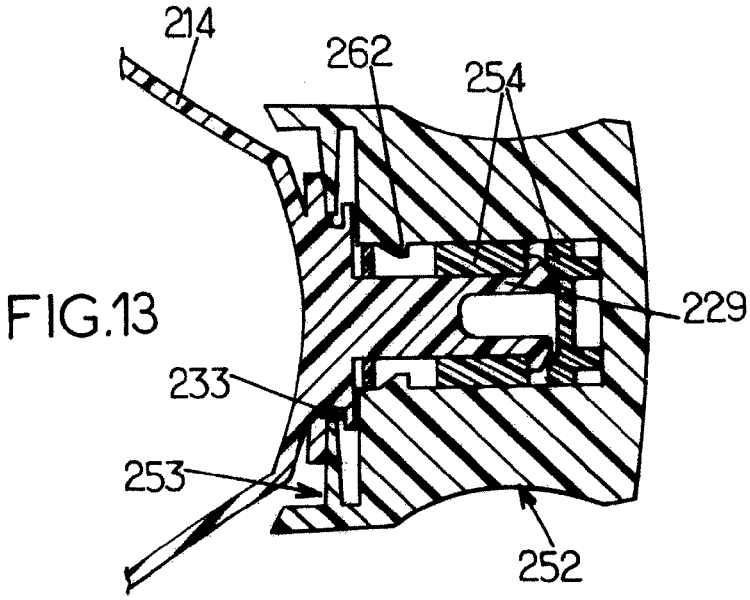
FIG. 13 is a diagrammatic representation in cross section of the lock elements of the shield and of the mask shown in FIGS. 7 and 8.

When the user, already wearing the mask 202 on his face, wishes to put on the shield 206, he takes hold of the shield 206 by means of the grasping device 252 and brings it toward the mask 202. Close to the mask 202, the positioning of the shield 206 is facilitated by the locking ramp 224. When the shield 206 is substantially correctly positioned on the mask 202, the user continues to press the grasping device 252 toward the mask 202. As shown in FIG. 13, the grasping device 252 is provided with two flexible blades 253 which, on passing the hard point constituted by the protuberances 233, tap on the shell 214 and thus produce an audible indication that the shield 206 is locked on the mask 202. By thus pressing the grasping device 252 toward the mask 202, the user has driven the carriage 254, which is mobile with respect to the grasping device 252 and which in this case comes to a stop against the latter. Thus, the locking blades 229 are deformed in order to penetrate into the carriage 254 and then are straightened elastically toward a position of rest in which their straight edges 231 cooperate with the carriage 254 in order to retain the locking nose 250 on the mask 202.

Figure 14:
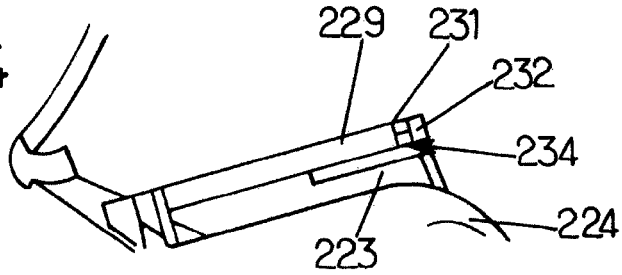
FIG. 14 is a diagrammatic representation in perspective of a part of the locking ramp of the mask shown in FIGS. 7 and 8.

As shown in FIG. 14, each pin 230 is provided in its lower part with an unlocking slope 234.

Figure 15:
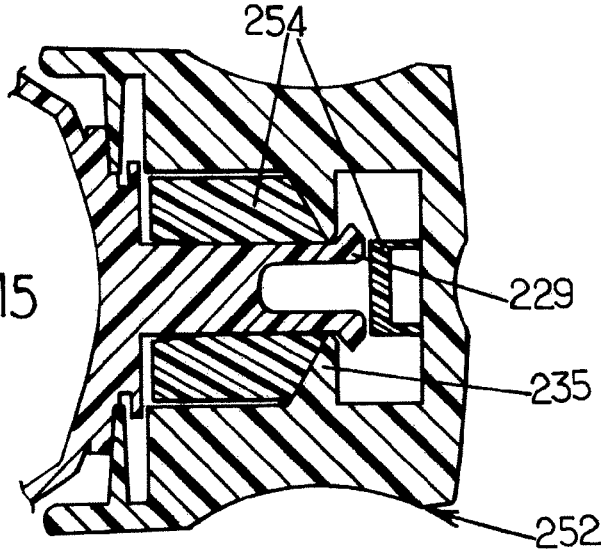
FIG. 15 is a diagrammatic representation in cross section, through a sectional plane lower than that of FIG. 13, of the lock elements of the shield and of the mask shown in FIGS. 7 and 8.

FIG. 15 corresponds to a cross section passing through the unlocking slopes 234. At this level, the grasping device comprises claws 235.

In order to withdraw the shield 206, starting from the position of use shown in FIG. 15, the user pulls the grasping device 252. The latter slides along the carriage 254. Thus the claws 235 cooperate with the unlocking slopes 234, pushing the locking blades 229 toward one another. The carriage 254 is driven by the grasping device 252, on the one hand due to the spring 249 and, on the other hand, due to the stops 262 (see FIG. 13). The pins then retract and the straight edges 231 disengage from the carriage 254. The flexible blades simultaneously clear the protuberances 233. The shield 206 is hence withdrawn from the mask 202, without necessitating any combined operation by the user. A single, simple movement suffices to detach the shield 206 from the mask 202.

When the user takes off the shield, the guidance members 239 pass under the sleeves 207 in order to release the shield from the straps 205.

One or more of the features described with respect to one or other of the two embodiments described above will of course be able to be combined and/or interchanged to provide variants of the protective equipment according to the invention.

The invention claimed is:

1. A head protective equipment, comprising:

a breathing mask connectable to a breathing-gas source and adapted to be applied, in a use position, over a bottom part of a user's face, around the user's nose and mouth, for supplying said user with breathing gas, an eye protective shield adapted to be applied over a top part of said user's face, around the user's eyes, and first and second lock elements, respectively located on said mask and on said shield and adapted to cooperate with each other in order to secure said shield to said mask when said mask is in said use position on said user's face, wherein said first and second lock elements are adapted to engage and interlock with each other by a movement of bringing said shield closer to said mask, said movement having a downward component, with reference to said face top and bottom parts, and being directed along a first oblique direction oriented toward an inside of said mask, wherein said second lock element comprises a nipple extending, starting from said shield, in said first oblique direction, and wherein said nipple is adapted to move longitudinally, substantially in said first oblique direction, between a locked position and an unlocked position, within a grasping unit of said shield comprising grasping surfaces for a user's fingers.

2. The protective equipment as claimed in claim 1, wherein said mask comprises a substantially conical cavity narrowing toward said first lock element in order to guide said nipple of said second lock element toward said first lock element arranged at a bottom of said cavity, in said movement of bringing said shield toward said mask.

3. The protective equipment as claimed in claim 1, provided with a push-button placed and movable substantially between said grasping surfaces and manually operable in order to move said nipple from said locked position to said unlocked position.

4. A head protective equipment, comprising:

a breathing mask connectable to a breathing-gas source and adapted to be applied, in a use position, over a bottom part of a user's face, around the user's nose and mouth, for supplying said user with breathing gas, an eye protective shield adapted to be applied over a top part of said user's face, around the user's eyes, and first and second lock elements, respectively located on said mask and on said shield and adapted to cooperate with each other in order to secure said shield to said mask when said mask is in said use position on said user's face, wherein said first and second lock elements are adapted to engage and interlock with each other by a movement of bringing said shield closer to said mask, said movement having a downward component, with reference to said face top and bottom parts, and being directed along a first oblique direction oriented toward an inside of said mask, wherein said second lock element comprises a nipple extending, starting from said shield, in said first oblique direction, and wherein said mask has guidance surfaces, diverging from a ridge adapted to be situated substantially in coincidence with a user's nose bridge, and said nipple is flanked by two side parts that are adapted to be substantially symmetrical with respect to a median plane of symmetry of said user's face when the equipment is being worn by said user, said side parts extending between a high end close to said nipple and a low end distant from said nipple and adapted to become more distant from said median plane toward said low end, in order to allow the guidance, by said guidance surfaces, of the positioning of said shield on said mask.

5. The protective equipment as claimed in claim 4, wherein said mask comprises a substantially conical cavity narrowing toward said first lock element in order to guide said nipple of said second lock element toward said first lock element arranged at a bottom of said cavity, in said movement of bringing said shield toward said mask.

6. The protective equipment as claimed in claim 4, wherein said nipple is adapted to move longitudinally, substantially in said first oblique direction, between a locked position and an unlocked position, within a grasping unit of said shield comprising grasping surfaces for a user's fingers.

7. The protective equipment as claimed in claim 6, provided with a push-button placed and movable substantially between said grasping surfaces and manually operable in order to move said nipple from said locked position to said unlocked position.

8. A head protective equipment, comprising:

a breathing mask connectable to a breathing-gas source and adapted to be applied, in a use position, over a bottom part of a user's face, around the user's nose and mouth, for supplying said user with breathing gas, an eye protective shield adapted to be applied over a top part of said user's face, around the user's eyes, and first and second lock elements, respectively located on said mask and on said shield and adapted to cooperate with each other in order to secure said shield to said mask when said mask is in said use position on said user's face, wherein said first and second lock elements are adapted to engage and interlock with each other by a movement of bringing said shield closer to said mask, said movement having a downward component, with reference to said face top and bottom parts, and being directed along a first oblique direction oriented toward an inside of said mask, further comprising a push-button acting as a locking indicator and adapted to control blocking, in an active position, of any movement of said first lock element with respect to said second lock element, said push-button being in said active position only when said mask and said shield are secured to each other by a mutual interlocking of complementary shapes of said first and second lock elements.

9. The protective equipment as claimed in claim 8, wherein said second lock element comprises a nipple extending, starting from said shield, in a said first oblique direction.

10. The protective equipment as claimed in claim 9, wherein said mask comprises a substantially conical cavity narrowing toward said first lock element in order to guide said nipple of said second lock element toward said first lock element arranged at a bottom of said cavity, in said movement of bringing said shield toward said mask.

11. The protective equipment as claimed in claim 9, wherein said nipple is adapted to move longitudinally, substantially in said first oblique direction, between a locked position and an unlocked position, within a grasping unit of said shield comprising grasping surfaces for a user's fingers.

12. The protective equipment as claimed in claim 11, provided with a push-button placed and movable substantially between said grasping surfaces and manually operable in order to move said nipple from said locked position to said unlocked position.

13. The protective equipment as claimed in claim 9, wherein said mask has guidance surfaces, diverging from a ridge adapted to be situated substantially in coincidence with a user's nose bridge, and said nipple is flanked by two side parts that are adapted to be substantially symmetrical with respect to a median plane of symmetry of said user's face when the equipment is being worn by said user, said side parts extending between a high end close to said nipple and a low end distant from said nipple and adapted to become more distant from said median plane toward said low end, in order to allow the guidance, by said guidance surfaces, of the positioning of said shield on said mask.

14. A head protective equipment, comprising:

a breathing mask connectable to a breathing-gas source and adapted to be applied, in a use position, over a bottom part of a user's face, around the user's nose and mouth, for supplying said user with breathing gas, an eye protective shield adapted to be applied over a top part of said user's face, around the user's eyes, and first and second lock elements, respectively located on said mask and on said shield and adapted to cooperate with each other in order to secure said shield to said mask when said mask is in said use position on said user's face, wherein said first and second lock elements are adapted to engage and interlock with each other by a movement of bringing said shield closer to said mask, said movement having a downward component, with reference to said face top and bottom parts, and being directed along a first oblique direction oriented toward an inside of said mask, wherein said mask comprises a locking ramp adapted to guide an attachment nose comprising said second lock element of said shield toward a locked position of said shield on said mask, while said shield is moving toward said mask, and wherein said locking ramp has a first branch superimposed with said first lock element and which is oriented with a component that is downward and toward an interior of said mask, said locking ramp having a second branch oriented downward from a free end of said first branch.

15. The protective equipment as claimed in claim 14, wherein said first and second lock elements are adapted to allow a movement of said shield with respect to said mask, and to favor the application of said shield over said user's face.

16. The protective equipment as claimed in claim 15, wherein said first and second lock elements are mobile with respect to each other, about a horizontal axis, by means of two links.

17. A head protective equipment, comprising:

a breathing mask connectable to a breathing-gas source and adapted to be applied, in a use position, over a bottom part of a user's face, around the user's nose and mouth, for supplying said user with breathing gas, an eye protective shield adapted to be applied over a top part of said user's face, around the user's eyes, and first and second lock elements, respectively located on said mask and on said shield and adapted to cooperate with each other in order to secure said shield to said mask when said mask is in said use position on said user's face, wherein said first and second lock elements are adapted to engage and interlock with each other by a movement of bringing said shield closer to said mask, said movement having a downward component, with reference to said face top and bottom parts, and being directed along a first oblique direction oriented toward an inside of said mask, wherein said first and second lock elements are adapted to allow a movement of said shield with respect to said mask, and to favor the application of said shield over said user's face, further comprising spring means adapted to bring said shield toward said user's face, when said shield is secured to said mask and when said mask is worn by said user.

18. The protective equipment as claimed in claim 17, comprising a harness fitted with straps adapted to maintain said mask in said use position on said user's head and in which said shield comprises two guidance members adapted for each one respectively to become inserted under a strap of said harness when putting said shield into position on said mask.

19. The protective equipment as claimed in claim 18, wherein said guidance members are adapted to cause said straps, under which said guidance members are inserted while said shield is being put into position on said mask, to rise over sides of said shield.

20. The protective equipment as claimed in claim 17, wherein said first and second lock elements are mobile with respect to each other, about a horizontal axis, by means of two links.

21. A head protective equipment, comprising:

a breathing mask connectable to a breathing-gas source and adapted to be applied, in a use position, over a bottom part of a user's face, around the user's nose and mouth, for supplying said user with breathing gas, an eye protective shield adapted to be applied over a top part of said user's face, around the user's eyes, and first and second lock elements, respectively located on said mask and on said shield and adapted to cooperate with each other in order to secure said shield to said mask when said mask is in said use position on said user's face, wherein said first and second lock elements are adapted to engage and interlock with each other by a movement of bringing said shield closer to said mask, said movement having a downward component, with reference to said face top and bottom parts, and being directed along a first oblique direction oriented toward an inside of said mask, wherein said second lock element comprises a nipple extending, starting from said shield, in said first oblique direction, and wherein said first lock element comprises a first ramp which is circular and continuous about said first oblique direction, and wherein the nipple is engaged in a locked position with said ramp.

22. The protective equipment as claimed in claim 21, wherein said mask comprises a substantially conical cavity narrowing toward said first lock element in order to guide said nipple of said second lock element toward said first lock element arranged at a bottom of said cavity, in said movement of bringing said shield toward said mask.

23. The protective equipment as claimed in claim 22, provided with a push-button placed and movable substantially between said grasping surfaces and manually operable in order to move said nipple from said locked position to said unlocked position.

24. The protective equipment as claimed in claim 21, wherein said nipple is adapted to move longitudinally, substantially in said first oblique direction, between a locked position and an unlocked position, within a grasping unit of said shield comprising grasping surfaces for a user's fingers.

25. The protective equipment as claimed in claim 21, wherein said mask has guidance surfaces, diverging from a ridge adapted to be situated substantially in coincidence with a user's nose bridge, and said nipple is flanked by two side parts that are adapted to be substantially symmetrical with respect to a median plane of symmetry of said user's face when the equipment is being worn by said user, said side parts extending between a high end close to said nipple and a low end distant from said nipple and adapted to become more distant from said median plane toward said low end, in order to allow the guidance, by said guidance surfaces, of the positioning of said shield on said mask.

* * * * *

UNITED STATES PATENT AND TRADEMARK OFFICE

CERTIFICATE OF CORRECTION

PATENT NO. : 7,549,420 B2
APPLICATION NO. : 10/517419
DATED : June 23, 2009
INVENTOR(S) : Martinez et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1100 days.

Signed and Sealed this

Twenty-sixth Day of October, 2010

David J. Kappos

David J. Kappos
*Director of the United States Patent and Trademark Office*